US009297178B2

(12) United States Patent
Dalo

(10) Patent No.: US 9,297,178 B2
(45) **Date of Patent: *Mar. 29, 2016**

(54) SUSPENDED FALSE CEILING FOR LIGHTWEIGHT HOUSING MODULE

(75) Inventor: Catherine Dalo, Saint Martin de Nigelles (FR)

(73) Assignee: Catherine Dalo, Saint Martin de Nigelles (FR)

( * ) Notice: Subject to any disclaimer, the term of this patent is extended or adjusted under 35 U.S.C. 154(b) by 519 days.

This patent is subject to a terminal disclaimer.

(21) Appl. No.: 13/072,303

(22) Filed: Mar. 25, 2011

(65) Prior Publication Data

US 2011/0259383 A1 Oct. 27, 2011

(30) Foreign Application Priority Data

Mar. 26, 2010 (FR) ..... 10 01238

(51) Int. Cl.
*E04H 15/04* (2006.01)
*E04B 9/00* (2006.01)
(Continued)

(52) U.S. Cl.
CPC *E04H 15/58* (2013.01); *E04B 9/00* (2013.01); *E04H 15/04* (2013.01); *E04H 15/26* (2013.01); *E04H 15/54* (2013.01); *E04H 15/64* (2013.01); *E04B 2009/0492* (2013.01)

(58) Field of Classification Search
CPC ..... E04H 15/18; E04H 15/26; E04H 15/32; E04H 15/44; E04B 9/00; E04B 9/001; E04B 7/14; Y10S 135/905
USPC ..... 135/90, 93–94, 98, 99, 121, 124, 135, 135/156–159, 120.1–120.4, 20.3; 52/80.1, 52/80.2, 82–83, 65–66, 506.06, 222
See application file for complete search history.

(56) References Cited

U.S. PATENT DOCUMENTS 214,996 A * 5/1879 Doane ..... 135/100
1,262,564 A * 4/1918 Reynolds ..... 52/63
(Continued)

FOREIGN PATENT DOCUMENTS

DE 1434570 A1 10/1969
DE 29600145 U1 4/1997
(Continued)

OTHER PUBLICATIONS

Preliminary Search Report of FR 10/01238; Jan. 14, 2011; Delzor Francois.
(Continued)

*Primary Examiner* — Winnie Yip
(74) *Attorney, Agent, or Firm* — BCF LLP

(57) ABSTRACT

This invention relates to a false ceiling intended to be suspended inside a lightweight housing module provided with at least one stretched fabric referred to as exterior forming its roof and fixed along its lower peripheral edge on a rigid frame, the false ceiling being of double inverted curvature and comprising a fabric referred to as interior being, on the one hand, suspended inside said lightweight housing module under the exterior fabric and, on the other hand, fixed by its exterior peripheral edge to said frame, the false ceiling being remarkable in that said interior fabric comprises in its central portion an orifice of dimensions that are sufficient to allow for the passing of an operator and in that said interior fabric is sufficiently resistant and stretched in order to support the weight of at least one operator. This invention further relates to its method of assembly.

13 Claims, 3 Drawing Sheets

(51) Int. Cl.

| | |
|---|---|
| ***E04H 15/58*** | (2006.01) |
| ***E04H 15/26*** | (2006.01) |
| ***E04H 15/54*** | (2006.01) |
| ***E04H 15/64*** | (2006.01) |
| *E04B 9/04* | (2006.01) |

(56) References Cited

U.S. PATENT DOCUMENTS

| | | | | | |
|---|---|---|---|---|---|
| 1,428,139 | A | * | 9/1922 | Brown | 396/4 |
| 1,900,274 | A | * | 3/1933 | Brockie | 135/147 |
| 2,795,830 | A | * | 6/1957 | Leatherman | 24/713.8 |
| RE26,121 | E | * | 12/1966 | Wiegand | 169/5 |
| 3,338,000 | A | * | 8/1967 | Ostrander et al. | 52/2.17 |
| 3,521,416 | A | * | 7/1970 | Joor | 52/222 |
| 3,906,685 | A | | 9/1975 | Howard | |
| 3,945,106 | A | * | 3/1976 | Mayr et al. | 29/429 |
| 4,602,468 | A | * | 7/1986 | Simpson | 52/410 |
| 4,763,452 | A | * | 8/1988 | Harvey | 52/96 |
| 4,901,484 | A | | 2/1990 | Santosuosso | |
| 5,076,031 | A | * | 12/1991 | Hancock | 52/63 |
| 5,140,788 | A | | 8/1992 | Lynch | |
| 5,522,186 | A | | 6/1996 | Jarman | |
| 6,279,284 | B1 | | 8/2001 | Moras | |
| 6,345,638 | B1 | | 2/2002 | Warner | |
| 6,789,978 | B1 | * | 9/2004 | Yoshinari | 403/381 |
| 7,314,055 | B2 | * | 1/2008 | Guo et al. | 135/156 |

FOREIGN PATENT DOCUMENTS

| | | | | | |
|---|---|---|---|---|---|
| EP | 467867 | A1 | * | 1/1992 | E04H 15/18 |
| EP | 0277073 | B1 | | 6/1992 | |
| EP | 0908570 | A1 | | 4/1999 | |
| EP | 1712709 | A1 | | 10/2006 | |
| EP | 1905926 | A1 | | 4/2008 | |
| EP | 1932983 | A1 | | 6/2008 | |
| EP | 2130994 | A1 | | 12/2009 | |
| FR | 799306 | A | | 6/1936 | |
| FR | 2578281 | A1 | * | 9/1986 | E04H 15/42 |
| FR | 2666612 | A1 | * | 3/1992 | E04B 1/58 |
| FR | 2691495 | A1 | * | 11/1993 | E04H 15/02 |
| FR | 2684712 | B1 | | 9/1998 | |
| FR | 2770864 | A1 | | 5/1999 | |
| FR | 2955135 | A1 | | 7/2011 | |
| JP | 04289390 | A | * | 10/1992 | E04H 15/00 |
| WO | WO 9221843 | A1 | * | 12/1992 | E04G 21/14 |

OTHER PUBLICATIONS

English Abstract of EP 1932983.
English Abstract of EP 1905926.
English abstract of EP 2 130 994 retrieved from Espacenet on May 3, 2013.
English abstract of EP 0 277 073 retrieved from Espacenet on May 3, 2013.
English abstract of FR 2 684 712 retrieved from Espacenet on May 3, 2013.
English abstract of FR 2 955 135 retrieved from Espacenet on May 3, 2013.
Preliminary Search Report of FR10/01236; Jan. 12, 2011; Zuurveld, Gerben.
English abstract of EP 0908570 retrieved from Espacenet on Apr. 7, 2014.
English abstract of FR 2770864 retrieved from Espacenet on Apr. 7, 2014.
English abstract of EP1712709 retrieved from Espacenet on Apr. 7, 2014.

* cited by examiner

Fig. 2b
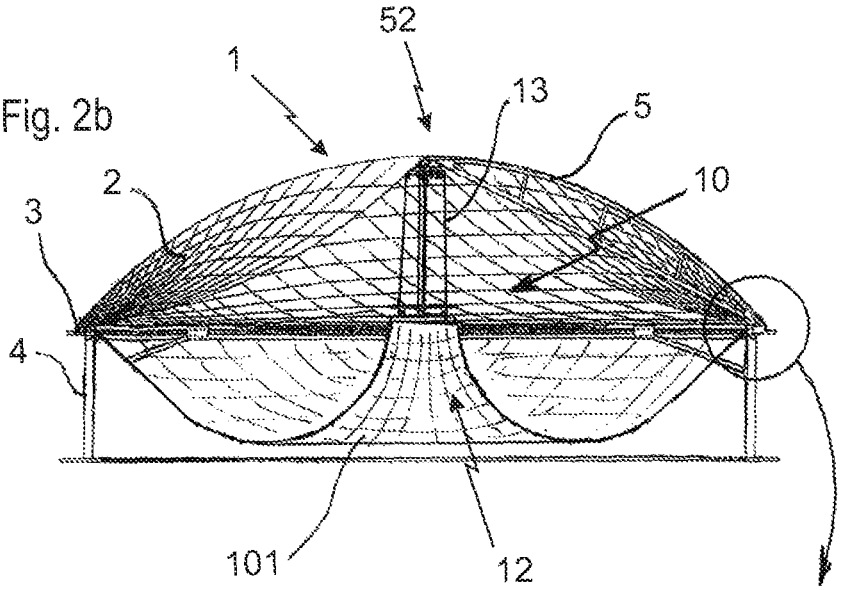
Fig. 5
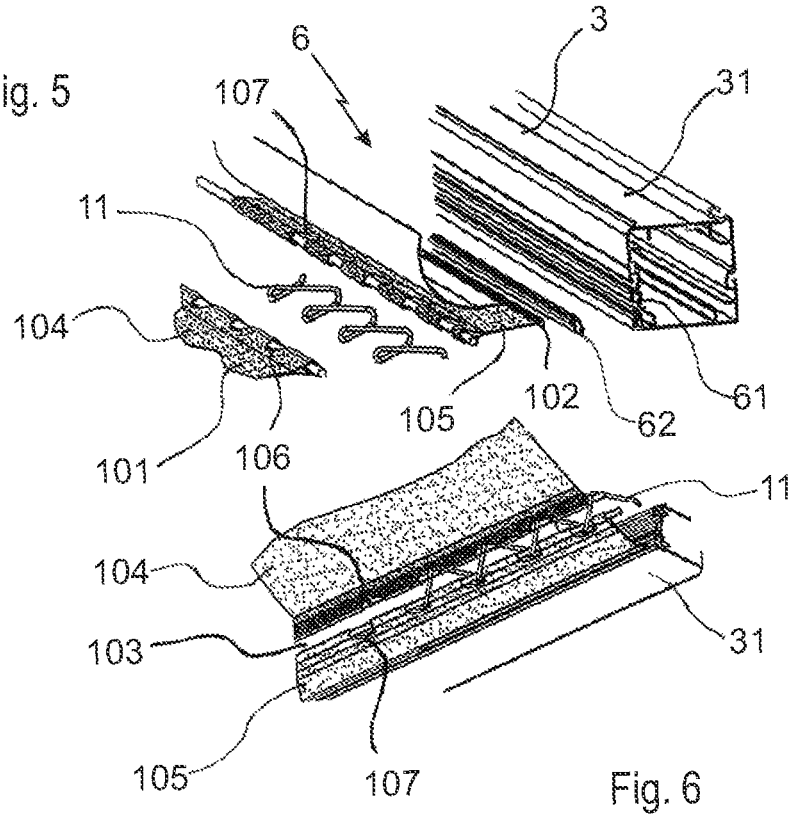
Fig. 6

SUSPENDED FALSE CEILING FOR LIGHTWEIGHT HOUSING MODULE

TECHNICAL FIELD

This invention relates to a false ceiling intended to be suspended inside a lightweight housing module, this lightweight housing module comprising a stretched fabric intended to form its roof, said false ceiling comprising a stretched fabric under said roof of the lightweight housing module. The invention also has for object the method of assembly of this false ceiling.

PRIOR ART

The false ceilings that are known conventionally include one or several anchoring rails fixed on each of the walls and/or ceiling of a premises, and one flexible sheet, for example en polyvinyl chloride (PVC), generally opaque, which is deformed by stretching so that its edges, provided with means of anchoring, can become fixed to said rails using these means of anchoring, by taking care to properly stretch the sheet in order to provide a pleasant aspect.

However, these false ceilings have the disadvantage of being very flexible and of not being able to receive loads on their top without resulting in substantial particularly unsightly deformations and even tears, said deformations and/or tears also being due to the fact that these false ceilings are generally flat and therefore not very resistant to the mechanical loads. As such in order to increase the thermal and sound insulation of said false ceilings, insulating materials such as mineral wool for example will not be able to be placed on their upper surface. Likewise, an operator will not be able to walk on the top of a false ceiling of this type in order to, for example, carry out operations of maintenance and/or inspection of the seal of the roof of said lightweight housing module.

Moreover, lightweight housing modules are already known comprising a stretched fabric intended to form the roof of said module and conventionally fixed along its lower peripheral edge on a rigid frame maintained at a distance from the ground par a plurality of lateral posts which are in turn fixed on the ground. Said fabric can then be stretched by fixing its central portion to the upper end of a central mast then by pulling on the lower edge of said fabric by suitable means. The fabric can also be stretched by at least one arch subdivided into two semi-arches of which the lower ends each press against the rigid frame, and of which the upper ends are connected to one another by a device making it possible to separate said upper ends from one another in order to obtain, on the one hand, the upward deformation by buckling of said arch and, on the other hand, the stretching of the fabric. The vertical faces coming from the periphery of the rigid frame are then closed by plates or opaque, transparent or translucent fabric, in order to obtain a lightweight housing module. These lightweight housing modules are easy to implement as they do not require tools or complicated equipment or highly-qualified personnel. However, these lightweight housing modules are not economical as they have a high operating cost in particular in heating. Indeed, these lightweight housing modules have a high thermal permeability.

DESCRIPTION OF THE INVENTION

The purpose of this invention is therefore to overcome the aforementioned disadvantages and to propose a false ceiling intended to be suspended inside a lightweight housing module, making it possible to increase the thermal and sound insulation characteristics of said lightweight housing module while being particularly resistant and simple to implement.

In accordance with the invention, it is therefore proposed a false ceiling intended to be suspended inside a lightweight housing module provided with at least a stretched fabric referred to as "exterior" forming its roof and fixed along its lower peripheral edge on a rigid frame maintained at a distance from the ground by a plurality of lateral posts, the false ceiling being of double inverted curvature and comprising a fabric referred to as "interior" being, on the one hand, suspended inside said lightweight housing module under the exterior fabric and, on the other hand, fixed by its exterior peripheral edge to said frame in such a way as to create a "heat and sound cushion". This false ceiling being remarkable in that said interior fabric comprises in its central portion an orifice of dimensions that are sufficient to allow for the passing of an operator and in that said interior fabric is sufficiently resistant and stretched in order to support the weight of at least one operator.

Finally, this invention further relates to a method of assembly of a false ceiling according to the invention inside a lightweight housing module, remarkable in that it includes at least the following steps:

- fastening of the connecting members inside the lightweight housing module,
- setting up means of connecting on said connecting members,
- fastening of the lower peripheral edge of the interior fabric on the means of connecting,
- fastening of the exterior peripheral edge of the interior fabric on the frame of the lightweight housing module,
- raising and suspending of the interior peripheral edge of the interior fabric by said means of connecting and connecting members.

SUMMARY DESCRIPTION OF THE FIGURES

Other advantages and characteristics shall become clearer in the following description of an alternative embodiment of a support unit of a false ceiling according to the invention in reference to the annexed figures wherein:

FIG. 1 is a cross-section view of a false ceiling according to the invention inside a lightweight housing module according to a first embodiment;

FIGS. 2*a* to 2*b* are cross-section views of the false ceiling according to FIG. 1 in the process of being mounted, at different stages of this mounting;

FIG. 5 is an exploded perspective detailed view of the system for fastening the fabric of the false ceiling according to FIG. 1;

FIG. 6 is a perspective detailed view corresponding to FIG. 5;

BEST MANNER FOR CARRYING OUT THE TECHNICAL INVENTION

Figure 1:
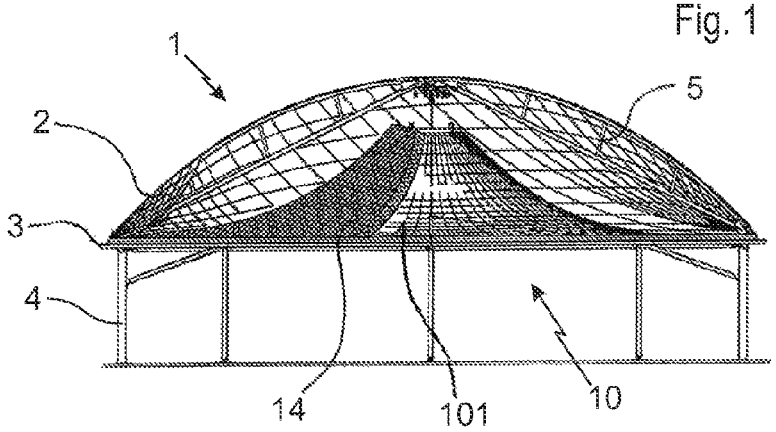

FIGS. 1 to 5 show a first embodiment of a lightweight housing module 1 comprising a stretched fabric 2 names "exterior", intended to form the roof of said lightweight housing module 1 and to be fixed along its lower peripheral edge on a rigid frame 3 maintained at a distance from the ground by a plurality of lateral posts 4 which are in term fixed on the ground.

The frame 3 comprises more preferably spars 31 joined and fixed together by means not shown on the drawing, each of the spars 31 being constituted of a profiled element made of light alloy, of solid or hollow substantially rectangular straight section. The frame 3 comprises means of fastening (not shown) able to receive the posts 4.

Furthermore, the lightweight housing module 1 further comprises vertical panels and/or opening frames (not shown) in order to close in a substantially sealed manner the vertical facades located along the perimeter of the frame 3.

In order to obtain the stretching of the exterior fabric 2, the lightweight housing module 1 comprises a system for stretching comprising a framework 5 formed by at least one arch subdivided into two semi-arches 51 of which the lower ends each press against the frame 3, and of which the upper ends are connected to each other by a device for separating 52 such as that described in European patent application EP 2 130 994 filed in the name of the applicant. The separation of said upper ends from the semi-arches 51 causes an upward displacement of the median portion of the arch and therefore a stretching of the fabric 2 since its lower edge is fixed on the frame 3.

This device for separating 52 (see FIG. 3) comprises means of connecting of the type by sliding press-fitting of a tube 53 inside one at least of the upper ends of the semi-arches 51, and means for separation of said upper ends comprising engaging members 54 respectively integral with both of the upper ends and a threaded member 55 cooperating with said engaging members 54 with the purpose of bringing closer and/or inversely the separation of said ends from one another. The threaded member 55 is constituted of a threaded rod provided in its median zone with a member for maneuvering 56 in rotation and, at its ends, with threadings in the opposite direction of rotation. The engaging members 54 are made integral with the exterior of said upper ends and comprise interior threadings cooperating respectively with the corresponding threadings of the threaded rod.

Finally, this first embodiment of lightweight housing module 1 comprises a false ceiling 10, according to the invention, arranged inside said lightweight housing module 1. The false ceiling 10 comprises, in reference to FIG. 1, an interior fabric 101 referred to as "interior" suspended under the exterior fabric 2 of the lightweight housing module 1 and fixed by its exterior peripheral edge along the frame 3.

To do this, the exterior peripheral edge of the interior fabric 101 of the false ceiling 10 has a bead 102 arranged in order to be retained in a system for fastening 6 of the interior fabric 101 in the frame 3 of the lightweight housing module 1. Said system for fastening 6 is advantageously similar to that described in European patent EP 0 277 073 delivered in the name of the applicant.

As such, the system for fastening 6 (see FIGS. 5 and 6) is such that each of the spars 31 of the frame 3 has a groove 61 exiting via an inlet slot of a width less than that of the bottom of the groove 61 and that a lock ring 62 can be engaged transversally in the groove 61, through its inlet slot, and be immobilized therein in order to retain therein said bead 102 of the interior fabric 101 of the false ceiling 10. The system for fastening 6 is remarkable in that in locking position the lock ring 62 is in vertical position, at a right angle in relation to its introduction position via an inlet slot, and it is wedged inside the groove 61, in such a way that a traction force exerted towards the exterior, on the fabric 2, does not allow the bead 102 to escape from the groove 61.

However, in order to overcome any possible defects concerning dimensions and/or positioning, said interior fabric 101 advantageously comprises a compensation zone 103 able to absorb said defects thanks to a string 11 more preferably elastic (see FIGS. 5 and 6). Said compensation zone 103 is a peripheral cut-out in the interior fabric 101 of the false ceiling 10 separating the latter into a first central zone 104 and a second end zone 105 comprising the bead 102. The string 11 then connects in an adjustable manner the first and second zones 104, 105 passing alternatively in orifices 106, 107 arranged respectively in the first and second zones 104, 105. This compensation zone 103 also makes possible an adjustment of the aspect of the interior fabric 101 after suspension inside the lightweight housing module 1.

Moreover, the false ceiling 10 comprises means of connecting 12 in order to maintain in suspended position the interior fabric 101 in relation to the framework 5 of the lightweight housing module 1. These means of connecting 12 will be more preferably analogous to the means of connecting described in European patent application EP 1 905 926 filed in the name of the applicant.

As such, the interior fabric 101 comprises in its central portion an orifice 108 advantageously provided with a ring 109, i.e. a bead. This ring 109 is formed by a ring taken in a fold of said interior fabric 101, said ring being for example made form a cord, natural or synthetic.

Figure 3:
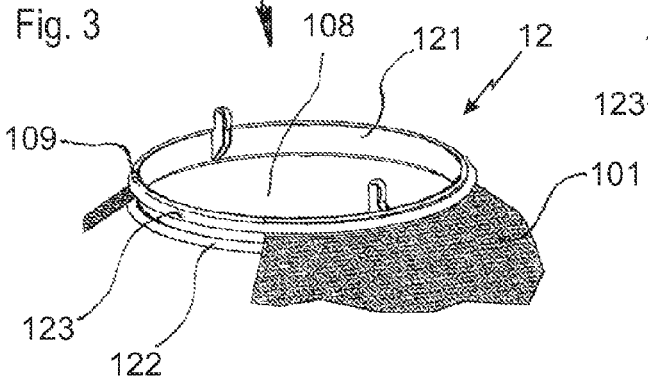
FIG. 3 is a partial detailed view of the means of connecting of the false ceiling according to FIG. 1.
Figure 7:
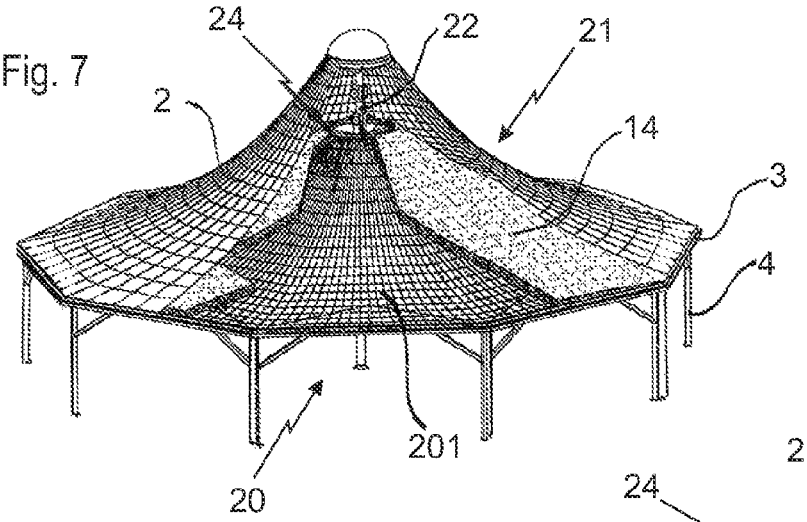
FIG. 7 is a partial perspective view of an alternative of false ceiling according to the invention inside a lightweight housing module according to a second embodiment.
Figure 8:
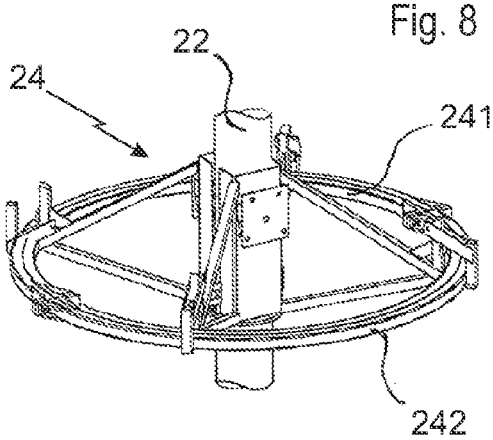
FIGS. 8 and 9 are partial perspective detailed views of the means of fastening of the false ceiling according to FIG. 7.
Figure 9:
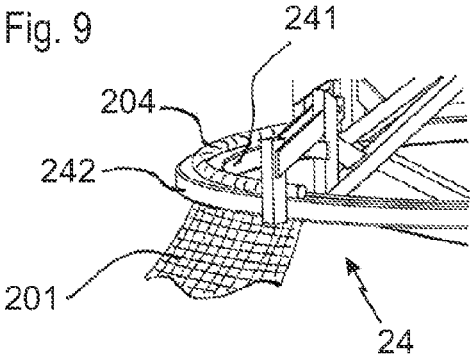

The means of connecting 12 comprise a segment 121, i.e. an annular portion, intended to receive on its exterior face the ring 109 of the interior fabric 101. This segment 121 is provided at its base with a stop 122 extending radially towards the exterior, for example fixed to the segment 121 by welding, and a locking ring 123 which, in the position where the false ceiling 10 is mounted (as shown in FIG. 3), is interposed between the ring 109 and the stop 122, as such providing the blocking of the ring 109.

The false ceiling 10 further comprises connecting members 13 (see FIG. 4) of the means of connecting 12, and in particular of the segment 121, to each of the upper ends of the semi-arches 51 of the framework 5 of the lightweight housing module 1. These connecting members 13 provide the maintaining in suspended position of the fabric 101 of the false ceiling 10. For this, said connecting members 13 are advantageously of the pulley-cable type, in such a way that by pulling on a cable the unit (segment 121-ring 109-locking ring 123) is brought closer to the upper ends of the semi-arches 51 in order to raise it and to suspend the interior fabric 101.

In light of the preceding, the false ceiling 10 is of double inverted curvature, i.e. it has a general shape of a Chinese hat, in other words a tapered surface of revolution of which the cone distance is not a straight line but a curve. This shape has for effect to increase the rigidity of the false ceiling 10.

It is understood that the false ceiling 10 according to the invention has for effect, on the one hand, to reduce the volume to be heated by decreasing the ceiling height and, on the other hand, to create a "heat cushion" by imprisoning the air contained in the entire portion of the lightweight housing module 1 located on top of the frame 3 between the exterior and interior fabrics 2 and 101.

It is understood that in reducing the volume to be heated, the operating cost in particular in terms of heating will be reduced substantially.

However, in order to increase the thermal performance of the false ceiling 10 and therefore of the lightweight housing module 1, the false ceiling 10 can comprise at least one batt insulation 14 arranged by the orifice 108 (see FIG. 1) above the interior fabric 101 and constituted of insulation materials such as mineral wool or polystyrene for example in the form of plates or rolls to be unwound. These insulation materials are introduced via the orifice 108 after the stretching of the interior fabric 101 then deposited onto the top of said interior fabric 101.

In light of the configuration in particular of the means of connecting 12, an operator can, by passing through the orifice 108 and by walking on the top of the interior fabric 101, verify from the interior the state of the exterior fabric 2 forming the roof of the lightweight housing module 1, but also the state of the framework 5 of the system for stretching of said exterior fabric 2. The orifice 108 is consequently of dimensions that are sufficient to allow for the passing of insulation materials and an operator.

It is understood that the interior fabric 101 of the false ceiling 10 must be sufficiently resistant, in terms of its material as well as in terms of its fastening, and stretched in order to support the weight of at least one operator and/or of a batt insulation 14 and make it possible for an operator to walk on the top of said interior fabric 101 in order, for example, to unroll the rolls of insulation materials in order to constitute at least said batt insulation 14.

Moreover, it is understood that the interior fabric 101 must be sufficiently stretched and resistant so that it does not become deformed or worse becomes torn when in particular the batt insulation 14 is put into place above it, in accordance with FIG. 1.

Finally, it is understood that the double inverted curvature shape has for effect to increase the rigidity and the mechanical resistance of the false ceiling 10 but also to provide the maintaining in place of the batt insulation 14.

In order to perfect the esthetics and the insulation of the false ceiling 10, the orifice 108 will be advantageously closed by a sealing cap (not shown).

It is understood that the fact of setting up at least one batt insulation 14 above the interior fabric 101 makes it possible to increase the thermal insulation but also the sound insulation of the false ceiling 10.

However, in order to further increase the sound insulation of said false ceiling 10, the interior fabric 101 can be at least in part punched and therefore provided with orifices of which the dimensions are of a magnitude of a few millimeters.

Advantageously, the interior fabric 101 is entirely punched. In a preferred embodiment, the interior fabric 101 is carried out using a punched textile fabric.

Those skilled in the art will have no difficulty in determining the material and the thickness of the interior fabric 101 in order to provide the proper mechanical resistance of the false ceiling 10 even if the interior fabric 101 is in part punched.

Figure 2A:
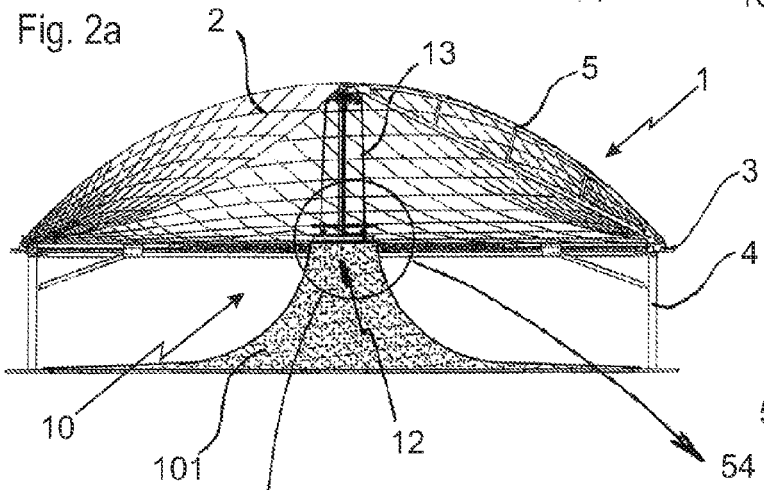
Figure 4:
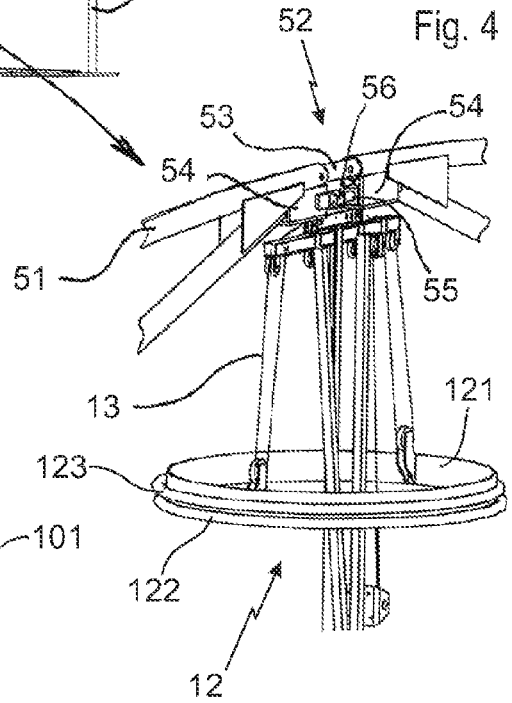
FIG. 4 is a partial detailed view of the means of connecting of the false ceiling according to FIG. 1.

In reference to FIGS. 2*a* to 2*b*, the invention also has for purpose a method of assembly of the false ceiling 10 suspended inside a lightweight housing module 1 comprising a plurality of steps, i.e.:

- fastening of the connecting members 13 inside the lightweight housing module 1,
- setting up means of connecting 12 on said connecting members 13,
- fastening of the interior peripheral edge of the interior fabric 101 on the means of connecting 12,
- fastening of the exterior peripheral edge of the interior fabric 101 on the frame 3 of the lightweight housing module 1,
- raising and suspending of the interior peripheral edge of the interior fabric 101 by said means of connecting 12 and connecting members 13.

It is understood that these steps may not be executed in the indicated order. For example, the fastening of the lower peripheral edge of the interior fabric 101 can be carried out after the fastening of the exterior peripheral edge of the interior fabric 101.

The step of fastening of the exterior peripheral edge of the interior fabric 101 of the false ceiling 10 according to the invention can be preceded by a step of slightly raising the interior fabric 101 by the connecting members 13 in order to facilitate said fastening of the exterior peripheral edge of the interior fabric 101.

Likewise, the step of suspending the interior fabric 101 can advantageously be followed by a step of adjusting the aspect of the interior fabric 101 thanks to the string 11 connecting the first and second zones 104, 105 of the interior fabric 101.

Finally, the step of suspending the interior fabric 101 can advantageously be followed by a step of setting up a batt insulation 14 arranged by the orifice 108 above the interior fabric 101 then a step of setting up a sealing cap of the orifice 108.

It is understood, according to the preceding description, that the mounting of the false ceiling 10 is particularly simple and requires very little equipment and tools.

DESCRIPTION OF OTHER EMBODIMENTS

FIGS. 7 to 10 show an alternative embodiment of the false ceiling 20 adapted for a second embodiment of lightweight housing module 21.

This second embodiment of lightweight housing module 21 is similar to the first embodiment of lightweight housing module 1 described previously and differs from it only by its system for stretching the exterior fabric 2 comprising a central mast 22. Said exterior fabric 2 can then be stretched by fixing its central portion to the upper end of said central mast 22 then by pulling on the lower edge of said fabric by suitable means.

However, the central mast 22 of the lightweight housing module 21 can be of the type of that described in French patent application FR 10/00127 filed in the name of the applicant. Said central mast 22, which carries, at its upper end, the central portion of the exterior fabric 2 fixed along its lower edge to the frame 3, is articulated in order to facilitate its placing into vertical position and extendible in order to stretch said exterior fabric 2 by pushing the central portion of the exterior fabric 2 upwards.

Regardless of the type of central mast 21, it is understood that the false ceiling 20 will be put into place around said central mast 22.

Figure 10:
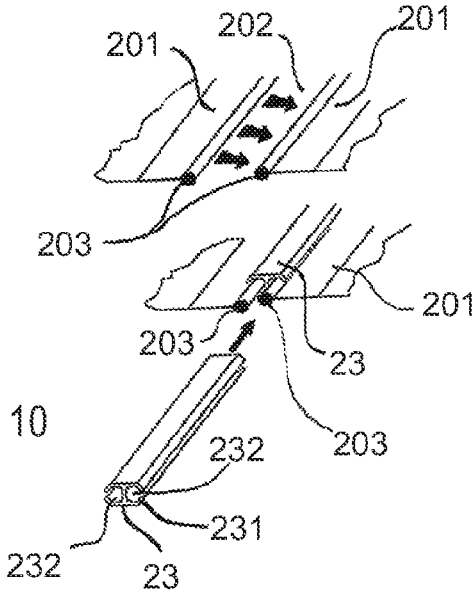
FIG. 10 is a series of detailed perspective views of the connecting member of the false ceiling according to FIG. 7 in the process of being mounted on the fabric.

For this, the false ceiling 20 is differentiated from the previously-described false ceiling 10 in that it comprises, in reference to FIG. 10, an interior fabric 201, similar to the previously-described interior fabric 101, having furthermore a section 202 joining its interior peripheral edge to its exterior peripheral edge fixed and a connecting member 23 able to cooperate with the edges of said section 202 in order to connect together and form a continuous surface around the central mast 22 by closing its interior and exterior peripheral edges. This connecting member 23 is a profile of which the length is substantially equal to that of the section 202 and having a section in the general shape of an H of which the free ends 231 are slightly folded back over themselves in such a way as to form two housings 232 able to receive said edges of the section 202 each having a bead 203 (see FIG. 10). In order to set the connecting member 23 in place, one must engage simultaneously, more preferably, one of the ends of the two beads 203 into the housings 232 of said connecting member 23 and slide said connecting member 23 until the other ends of said beads 203 of the interior fabric 201.

Likewise, the false ceiling 20 is differentiated from the false ceiling 10, described previously, in that it comprises, in reference to FIGS. 8 and 9, means of connecting 24 in order to maintain in suspended position the fabric 201 in relation to lightweight housing module 21, said means of connecting 24 being arranged in order to be set in place around said central mast 22.

As such, the means of connecting 24 comprise a segment 241, formed of two semi-segments assembled by means of fastening such as bolts for example, intended to receive the ring 204 of the interior fabric 201, and a locking ring 242 formed of two semi-rings assembled by means of fastenings such as bolts, for example, and arranged in order to be fixed on the segment 241. These means of connecting 24 are such that, in the position where the false ceiling 20 is mounted, the interior peripheral edge of the interior fabric 201 is interposed between the locking ring 242 and the segment 241 in such a way as to place the ring 204 above said blocking rings 242 and segment 241, as such providing the blocking of the ring 204.

It is understood that the method of assembly of this alternative of false ceiling 20 will include, in addition to the previously-described steps for the mounting of the false ceiling 10, steps for assembling means of connecting 24 and of the interior fabric 201 thanks to the setting up of the connecting member 23.

POSSIBILITY OF INDUSTRIAL APPLICATION

The false ceiling 10, 20 according to the invention is primarily intended to be suspended inside a lightweight housing module 1, 21, but it can also be installed inside any type of building, in particular bricked buildings, the frame 3 will then be constituted by the facade walls of said buildings. Furthermore, the description clearly shows that the false ceiling 10, 20 according to the invention is of simple and quick construction, and makes it possible to increase the high-performance sound as well as thermal insulation and therefore to reduce the operating cost of the lightweight housing module 1, 21.

Finally, it is understood that the examples of false ceiling 10, 20 in accordance with the invention which have just been described are only particular illustrations, and in no case restrictive of the invention.

The invention claimed is:

1. A false ceiling being suspended inside a building having a roof having a lower peripheral edge fixed on a rigid frame, the false ceiling comprising:

an interior fabric having a shape, when suspended, of a concave and conical surface of revolution generated by rotating a curve about a vertical axis and being adapted to be suspended inside the building under and independently of the roof, the interior fabric having an exterior peripheral edge adapted to be fixed to the rigid frame of the and connected to the lower peripheral edge of the roof in such a way as to create a heat and sound cushion with the roof, and a central portion being disposed, when suspended, above the exterior peripheral edge, the central portion defining an orifice to access a top of the interior fabric.

2. The false ceiling according to claim 1, wherein the orifice is provided with a ring.

3. The false ceiling according to claim 2, further comprising means of connecting comprising a segment and a blocking ring, the segment and blocking ring providing blocking of the ring of the orifice.

4. The false ceiling according to claim 3, further comprising connecting members adapted to connect the means of connecting to the building.

5. The false ceiling according to claim 4, wherein the connecting members include pulleys and cables.

6. The false ceiling according to claim 1, wherein the interior fabric comprises a compensation zone separating the interior fabric into a first central zone of the interior fabric and a second end zone of the interior fabric, the compensation zone comprising a string connected in an adjustable manner between the first central zone and the second end zone.

7. The false ceiling according to claim 1, further comprising a batt insulation arranged above the interior fabric.

8. The false ceiling according to claim 1, further comprising a sealing cap closing the orifice.

9. The false ceiling according to claim 1, wherein the interior fabric is at least partially punched.

10. A method for assembling a false ceiling inside a building having a roof having a lower peripheral edge fixed on a rigid frame, the false ceiling comprising:

an interior fabric having a shape, when suspended, of a concave and conical surface of revolution generated by rotating a curve about a vertical axis, the interior fabric comprising an exterior peripheral edge and a central portion defining an orifice to access a top of the interior fabric;

a plurality of connecting members; and a means of connecting, the method comprising steps of:

fastening the plurality of connecting members inside the building;

setting up the means of connecting on the plurality of connecting members;

fastening the central portion of the interior fabric on the means of connecting;

fastening the exterior peripheral edge of the interior fabric on the frame of the building; and raising and suspending the central portion of the interior fabric by the means of connecting and the plurality of connecting members to create a heat and sound cushion with the roof.

11. The method according to claim 10, wherein the step of raising and suspending of the central portion of the interior fabric is followed by a step of adjusting the defects of the interior fabric by adjustment of a compensation zone along the interior fabric using a string.

12. The method according to claim 10, wherein the step of raising and suspending of the central portion of the interior fabric is followed by a step of setting up a batt insulation.

13. The method according to claim 11, wherein the step of raising and suspending of the central of the interior fabric is followed by a step of setting up a batt insulation.

* * * * *